United States Patent [19]

Otake

[11] 4,304,295

[45] Dec. 8, 1981

[54] CLEANING BODY INTERCEPTING APPARATUS FOR TUBE-TYPE HEAT-EXCHANGER

[75] Inventor: Katsumoto Otake, Hitachi, Japan

[73] Assignee: Hitachi, Ltd., Tokyo, Japan

[21] Appl. No.: 141,573

[22] Filed: Apr. 18, 1980

[30] Foreign Application Priority Data

Apr. 23, 1979 [JP] Japan ..... 54-48949

[51] Int. Cl.[3] ..... F28G 13/00; B08B 9/00

[52] U.S. Cl. ..... 165/95; 15/3.51

[58] Field of Search ..... 15/3.51; 165/95

[56] References Cited

U.S. PATENT DOCUMENTS

| | | | |
|---|---|---|---|
| 3,021,117 | 2/1962 | Trabrogge | 165/95 |
| 3,919,732 | 11/1975 | Honma et al. | 15/3.51 |
| 4,113,008 | 9/1978 | Treblim et al. | 165/95 |
| 4,135,574 | 1/1979 | Treblim et al. | 165/95 |

FOREIGN PATENT DOCUMENTS

| | | | |
|---|---|---|---|
| 857035 | 12/1960 | United Kingdom | 165/95 |

*Primary Examiner*—Samuel Scott
*Assistant Examiner*—Theophil W. Streule, Jr.
*Attorney, Agent, or Firm*—Craig and Antonelli

[57] ABSTRACT

A cleaning body intercepting apparatus for a tube-type heat-exchanger, with the apparatus including a cylindrical body, a pair of outer gratings disposed in the cylindrical body so as to receiving cleaning bodies from the heat-exchanger, at least a pair of inner gratings within the outer gratings for forming a pair of throat portions each adjacent to the side wall of the cylindrical body, and extraction tubes each disposed under each of the throat portions. The pair of throat portions each are surrounded by the outer and inner gratings so that the cleaning bodies from the heat-exchanger are introduced into the throat portions. The cleaning bodies passed through the throat portions are taken out the cylindrical body through the extraction tubes.

12 Claims, 8 Drawing Figures

CLEANING BODY INTERCEPTING APPARATUS FOR TUBE-TYPE HEAT-EXCHANGER

BACKGROUND OF THE INVENTION

The present invention relates to an apparatus for intercepting cleaning bodies used for cleaning a tube-type heat-exchanger.

The apparatus is disposed in a discharge or outlet conduit of the tube-type heat-exchanger for intercepting cleaning bodies such as, for example, balls made of elastic material, mixed in a liquid cooling media such as, for example a cooling water, with the cleaning bodies being passed through a plurality of heat conductive tubes or pipes and being returned to an inlet conduit of the heat-exchanger, whereby the heat-exchanger is continuously cleaned by the recirculating cleaning bodies during operation of the heat-exchanger.

A conventional type of the apparatus for intercepting cleaning bodies is disclosed in FIGS. 16 to 18 of U.S. Pat. No. 3,021,117. The apparatus comprises a conduit, a pair of upstream gratings, a pair of downstream gratings, and a discharge tube with a funnel disposed downstream of the downstream gratings for receiving cleaning bodies from the gratings and taking the cleaning bodies out of the conduit. The apparatus is excellent in that its construction is stable, relatively simple except for the gratings and it can surely intercept the cleaning bodies.

However, the apparatus also has various drawbacks. One of them is that the axial length of the conduit necessary to contain the gratings is large because the upstream and downstream gratings are generally the same in axial length and arranged axially in series. Therefore, the apparatus is large in size, so that the manufacturing transporting, and installation costs are increased. Another drawback is that a large pressure loss takes place when the cooling water flows in the apparatus because of obstruction in the flow of the cooling water, that is, the funnel of the discharge pipe and a throat portion defined by the gratings are disposed in a central portion of the conduit where the cooling water has the largest flow rate.

U.S. Pat. No. 3,021,117 additionally proposes a funnel shaped intercepting device formed of individual rings disposed coaxially in a step-like manner and held together by supporting bars. A disadvantage of this type of the intercepting apparatus is that it is structually weak so that it can not be adapted in a large capacity of apparatus having a conduit diameter more than 1000 mm. In the apparatus, the rings are disposed perpendicularly to a flow direction of a cooling water, and the cooling water flow is disturbed by the rings so that flow resistance is increased.

Another relevant prior art is Japanese utility model publication No. 43-21002 (1968). Wherein an apparatus for intercepting cleaning bodies for a tube-type heat-exchanger, is provided with a pair of ball passages for taking cleaning bodies out of a conduit at the side wall of the conduit. The side wall is necessarily of a complicated construction in order to provide for the pair of ball passages which partially extend along the side wall of the conduit.

SUMMARY OF THE INVENTION

An object of the invention is to provide apparatus for intercepting cleaning bodies used for cleaning a tube-type heat-exchanger, which apparatus in structurally stable, relatively short in its axial length, of a cylindrical body or a conduit contains a sieve means for intercepting cleaning bodies, and which ensures an interception and removal of the cleaning bodies from the cylindrical body.

Another object of the invention is to provide apparatus for intercepting cleaning bodies used for cleaning a tube-type heat-exchanger which is simple in construction and ensures an interception of the cleaning bodies without increasing a flow resistance of a liquid cooling media from the heat-exchanger.

Another object of the invention is to provide a cleaning body intercepting apparatus for a tube-type heat-exchanger, having a cleaning body interception portion with relatively small axial length and which ensures an interception and removal of cleaning bodies out of the cylindrical bodies without increasing an amount of the liquid cooling media discharged with the cleaning bodies and without increasing a flow resistance of the liquid cooling media flowing in the apparatus.

Briefly stated, the invention includes a first sieve means disposed in a cylindrical body for receiving and introducing cleaning bodies in a liquid cooling media from a tube-type heat-exchanger into a relatively narrow region, with a second sieve disposed so as to form with the first sieve means at least two throat portions at positions spaced from a central position of the cylindrical body. The throat portions are disposed, for example; at positions near the side wall of the cylindrical body and the cleaning bodies are collected or intercepted into the throat portions by the operation of the first and second sieve means, and removed through discharge conduits provided downstream of the throat portions.

DESCRIPTION OF THE PREFERRED EMBODIMENTS

Before embodiments of apparatus for intercepting cleaning bodies used for cleaning a tube-type heat exchanger according to the invention are described, an example of a heat-exchanging system in which the apparatus is applied will be described hereinafter, referring to FIG. 1.

Figure 1:
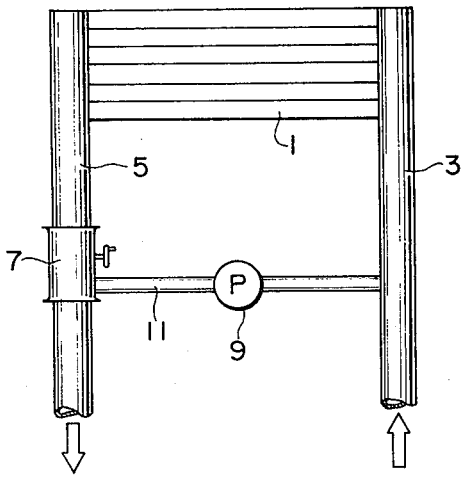
FIG. 1 is a schematic diagram of a heat-exchanging system, in which an installation example of an apparatus for intercepting cleaning bodies used for cleaning a tube-type heat-exchanger.

In FIG. 1, a tube-type heat exchanger 1 is provided which includes a plurality of heat-conductive tubes therein connected to a supply or inlet tube 3 and supplied with a liquid cooling media such as, for example, a cooling water through the inlet tube 3. The cooling water after being heat-exchanged is discharged through a discharge or outlet tube 5 with an apparatus generally designated by the reference numeral 7 for intercepting cleaning bodies being provided in the outlet tube 5. In order to clean the plurality of heat-conductive tubes of the heat-exchanger, a plurality of cleaning bodies such as sponge balls are thrown into the inlet tube 3 to pass through the plurality of heat-conductive tubes along with the cooling water. The heat-conductive tubes are rubbed by the cleaning bodies passing therethrough, whereby any scale deposited on the walls of the tubes is taken off. The cleaning bodies passed through the heat-conductive tubes are intercepted by the apparatus 7. The cleaning bodies are taken off therefrom by pump means 9 provided on an extraction pipe or passage 11, and again thrown into the inlet pipe 3. Thus, the heat-conductive tubes are repeatedly rubbed and cleaned by the recirculating cleaning bodies. While the cleaning of the heat-exchanger 1 is effected during operation of the heat-exchanger 1, the cleaning bodies are discharged along with the cooling water through the outlet tube 5 by the operation of the apparatus 7.

Next, an embodiment of the apparatus for intercepting cleaning bodies according to the invention will be described hereinafter in detail, referring to FIGS. 2 to 5.

Figure 2:
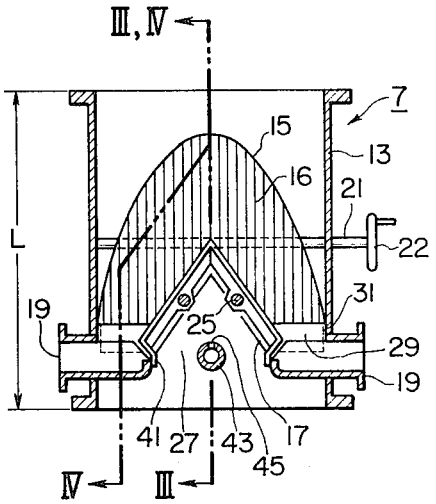
FIG. 2 is a cross-sectional view of an embodiment of apparatus for intercepting cleaning bodies used for cleaning a tube-type heat-exchanger according to the invention.
Figure 3:
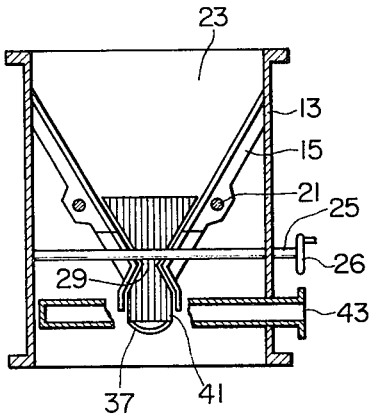
FIG. 3 is a cross-sectional view taken along a line III—III in FIG. 2.
Figure 4:
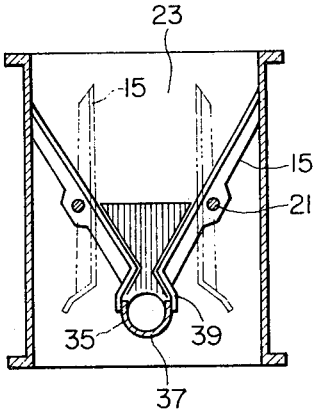
FIG. 4 is a cross-sectional sectional view taken along a line IV—IV in FIG. 2.

As shown most clearly in FIG. 2, the apparatus 7 for intercepting cleaning bodies comprises a cylindrical body 13 the respective ends of which are separably connected to the outlet tube, a first sieve means formed a pair of outer gratings 15, a second sieve means a pair of inner gratings 17, and a pair of extraction tubes or passages 19 each of which are connected to the extraction tube 11. The outer gratings 15 each have a plurality of parallel plates 16 which define a plurality of liquid passages extending along a liquid flow in the cylindrical body 13 and a flat sieve face by the side faces of the parallel plates 16. The gratings 15 are each formed with a half-elliptical shape at their periphery, and as shown most clearly in FIGS. 3 and 4, are secured at an intermediate portion to a shaft 21 in FIGS. 3 and 4. The shafts 21 are perpendicularly disposed and rotatably mounted on a side wall of the cylindrical body 13. The upper portions of the gratings 15 are in contact with the inside wall of the cylindrical body 13 so that a wide passage for cleaning bodies is defined. The wide passage becomes narrower toward downstream, whereby a relatively narrow V-shaped region 23 is defined by the pair of gratings 15. Referring back to FIG. 2, the pair of inner gratings 17 are disposed in the V-shaped region 23, with intermediate portions of the inner gratings 17 being secured to shafts 25, each of which extend perpendicularly to the axis of the cylindrical body 13, and are rotatably mounted on the side wall of the cylindrical body 13. The pair of inner gratings 17 are in contact with each other at the top portions thereof, and spaced at the bottom portions so that an inverted V-shaped region 27 is defined. Each of the gratings 17 has a generally V-shape and includes a plurality of parallel plates 18 defining therebetween a plurality of passages for cooling water which, as shown in FIG. 3, are disposed in a cooling water flow in the cylindrical body 13. The lower portions of the outer and inner gratings 15, 17 with portion 31 of the side wall of the cylindrical body 13 define a pair of throat portions or restricted passages 29. The throat portions 29 are spaced from a center longitudinal axis of the cylindrical body 13 near the side wall and discharge the cleaning bodies sieved by the gratings 15 and 17. The pair of extraction pipes 19 are mounted on the side wall of the cylindrical body 13 under the throat portion 29. The extraction pipes 19 each are partially cut off at the one ends and formed with inlet portions 35 for receiving the cleaning bodies. The inlet portions 35 are closely surrounded axially by tongue portions 39 of the outer gratings 15 extended from the throat portions 29. Tongue portions 41 extended from the throat portions 29 of the inner gratings 17 cover the ends 37 of the extraction pipes 19 so as to ensure the cleaning bodies passed through the throat portions 29 will be introduced into the extraction pipes 19.

The parallel plates 16 of the outer gratings 15 are in a adjacent relation to the parallel plates 18 (FIG. 5) of the inner gratings 17, and as shown in FIG. 2, each of them is partially cut off in an inversed V-shape under the inner gratings 17. Under the inner gratings 17, there is disposed a horizontal water jet pipe 43, one end of which is mounted on the cylindrical body 13. The pipe 43 has fine holes 45 formed on an upper side thereof, with the holes 45 being directed to the under faces of the inner and outer gratings 15, 17 so that a pressurized water is jetted to the gratings 15, 17 thereby preventing small stones, wooden pieces, etc. included in the cooling water from sticking on the gratings 15, 17.

Figure 5:
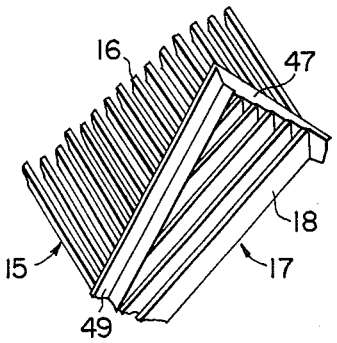
FIG. 5 is a perspective view of a portion of FIG. 2, that is, an abutment portion between an outer grating and an inner grating applied in the apparatus of FIG. 2.

As shown in FIG. 5 parallel plates 16 of the outer gratings 15 and the parallel plates 18 of the inner gratings 17 are not abutted in parallel to each other. The cooling water and cleaning bodies flowing along the parallel plates 16 are turned by the cooling water flowing along the parallel plates 18 about the abutment between the outer gratings 15 and the inner gratings 17, so that there is such a danger that some of the cleaning bodies may adhere between the outer and inner gratings 15 and 17. Therefore, it is preferable to provide guide members 47, 49 between the outer and inner gratings 15 and 17 with the guide members 47, 49 each being formed as a thin plate having an L-shape cross section, and being fixed to the outer gratings 15.

Next, the operation of the apparatus for intercepting cleaning bodies will be described hereinafter.

When the heat-exchanger 1 is in a normal operation, that is when its heat-exchanger is effected without cleaning the heat-exchange 1, the outer and inner gratings 15 and 17 are moved by rotating each of handles 22, 26 provided on one end of the respective shafts 21, 25 so that they will be in parallel to the cooling water flow as shown in FIG. 4. Under this condition, the operation of the heat-exchanger 1 is run normally.

When it is necessary to clean the heat-exchanger 1 with cleaning bodies, the inner gratings 17 are closed at the top as shown in FIG. 2 by rotating the handle 22 so that the tongue portions 41 will be in an adjacent or contracted relation to the ends 37 of the extraction pipes 19. The outer gratings 15 are opened so that the upper portions thereof will be contacted with the side wall of the cylindrical body 13 and the lower tongue portions 39 will be in an adjacent or contacted relation to the extraction tube 19. Thus, by the closing operation of the inner gratings 17 and the opening operation of the outer gratings 15, the pair of throat portions 29 are formed near the side wall of the cylindrical body 13. The throat portions 29 formed thus each are generally a rectangular in a plan view.

Cleaning bodies contained in a cooling water and used for cleaning the heat-exchanger are sieved and introduced by the pair of outer gratings 15 into the downstream, relatively narrow region. The cleaning bodies reaching the inner gratings 17 are further sieved and introduced by the outer and inner gratings 15, 17 into the pair of throat portions 29. The cleaning bodies passed through the throat portions 29 are taken off from the cylindrical body 13 through the extraction tubes 19, 11 and brought into the inlet tube 3 (of FIG. 1).

Distances between the parallel plates 16 or 18 are formed such that cleaning bodies a little larger than a diameter of the heat-conductive tubes of heat-exchanger 1 are not passed through by force of the cooling water flowing in the cylindrical body 13. The inner and outer gratings 15, 17 each are inclined against the axis of the cylindrical body 13 by a suitable angle so that the cleaning bodies can be easily rolled on the gratings 15, 17.

Major parts of the inner gratings 17, that is to say, the portions above the throat portions 29 in which cleaning bodies are substantially sieved, are disposed within the outer gratings 15, so that length L (FIG. 2) of the cylindrical body 13 necessary to provide therein members necessary to intercept cleaning bodies and take off them out of the cylindrical body 13 can be shorter than the conventional apparatus.

The cooling water flows faster at the axially central portion than at the side wall portion of the cylindrical body 13. The throat portions 29 and the extraction tubes 19 are disposed near the side wall where the flow rate of the cooling water is relatively small, and a few obstacles against the cooling water is disposed where the flow rate is relatively large, so that pressure loss of the cooling water is reduced greatly as compared with conventional apparatus. Additionally, since the parallel plates 16 of the outer gratings 15 are not in abutment to the inner gratings 17, pressure loss of the cooling water flowing there is reduced.

Cleaning bodies directed to the extraction tubes 19 pass through passages completely surrounded by the part of the side wall of cylindrical body 13, and the inner and outer gratings 17, 15. Therefore, the interception of the cleaning bodies, and introduction into the inlets 35 of the extraction tubes 19 are ensured so that a transportation of the cleaning bodies to the inlet tube 3 without increasing cooling water discharged through the extraction tubes 19 is also ensured. It is noted that the reduction of an amount of the cooling water flowing in the extraction tubes 19 results in increasing the heat exchanging efficiency in the heat-exchanger 1.

Figure 7:
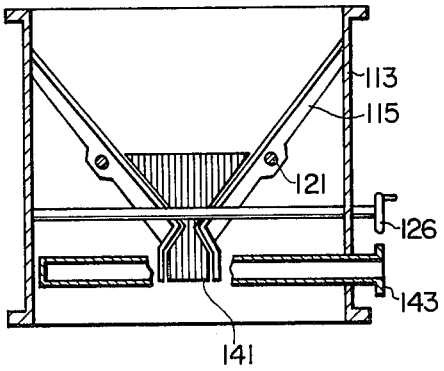
FIG. 7 is a cross-sectional view taken along a line VII—VII.
Figure 8:
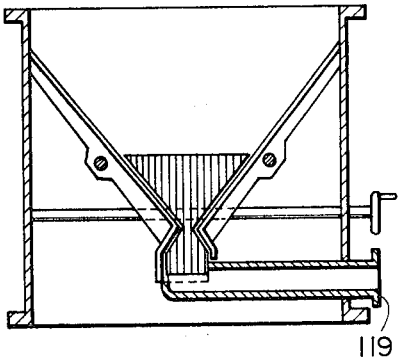
FIG. 8 is a cross-sectional view taken along a line VIII—VIII.

Another embodiment of the apparatus for intercepting cleaning bodies according to the invention will be described hereinafter, referring to FIGS. 6 to 8.

Figure 6:
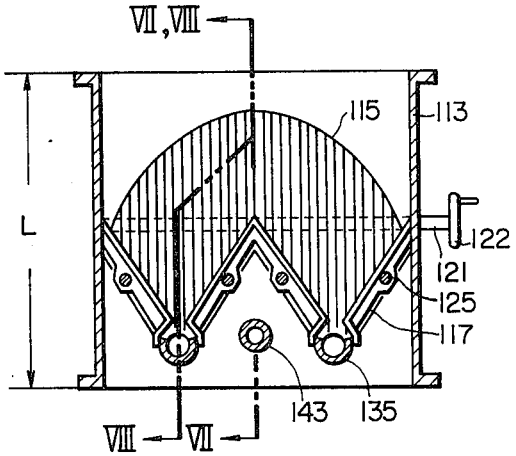
FIG. 6 is a front cross-sectional view of another embodiment of apparatus for intercepting cleaning bodies used for cleaning a tube-type heat-exchanger according to the present invention.

In FIG. 6, a conduit or cylindrical body 113 which is adapted to be used in an environment having a larger diameter than the described hereinabove embodiment. In the conduit 113, a first sieve means is formed of a pair of outer gratings 115 each of which is fixedly mounted on a shaft 121 with a handle 122, with the shaft 121 being rotatably supported by the conduit 113. A second sieve means is formed of a plurality of inner gratings 117 disposed between the pair of outer gratings 115, with the inner gratings 117 being fixed to shafts 125 rotatably supported by the conduit 113 and provided with handles 126. The inner gratings 117 are arranged such that two pairs of them will form a V-shape defining a throat portion 129 at its lower portion. Under each of the throat portion 129, the inlet 135 of an extraction tube is arranged. Between the inlets 135, a water jet pipe 143 is disposed so that pressurized water will be jetted to the underfaces of the inner gratings 117 so as to preventing small stones, wooden pieces contained in the cooling water.

The outer gratings 115 each have a plurality of parallel plates forming sieve means, which plates extend alfong the cooling water flow when the outer gratings 115 are disposed vertically, and terminate at the abutment between the outer gratings 115 and the inner gratings 117. Two of the inner gratings 117 disposed inside are contacted with each other at the tops during intercepting the cleaning bodies, and moved by the handle 126 in parallel to the cooling water flow when the normal operation starts. The other two inner gratings 117 are contacted with the side wall of the conduit 113 at the tops during the interception, and moved to be in parallel to the cooling water flow after the interception.

Cleaning bodies mixed in the cooling water in the conduit 113 are introduced by the outer and inner gratings 115, 117 into the inlets 135 of the extraction tubes or passages 119, and taken off out of the conduit 113 through the extraction tubes 119.

In this construction, the length L of the conduit 113 necessary to provide the outer and inner gratings 115, 117 and the extraction tube 119 can be reduced greater than the first embodiment of the invention. Therefore, it is preferable to use this embodiment in a large diameter conduit 113, while pressure loss of the cooling water increases a little because the positions of the throat portions 129 defined by the outer and inner gratings 115, 117 are more near the axis of the conduit 113 than these in the first embodiment.

As abovementioned, according to the invention the apparatus for intercepting cleaning bodies is stable and can greatly reduce an length of the cylindrical body to, for example half the length of the axial conventional apparatus shown in FIGS. 16 to 18 in U.S. Pat. No. 3,021,117. A cost for manufacturing the apparatus can be reduced to one half as compared with one of the conventional apparatus. Further, a cost for transportation the apparatus to a site and installing it also can be greatly reduced.

The apparatus for intercepting cleaning bodies according to the invention can surely intercept and remove cleaning bodies out of the heat-exchanger, without increasing a pressure loss of a cooling water.

What is claimed is:

1. Apparatus for intercepting cleaning bodies used for cleaning a tube-type heat-exchanger, the apparatus comprising:

conduit means through which a liquid cooling media flows;

first sieve means disposed in said conduit means for defining a relatively narrow region in a downstream portion of the conduit means and for introducing the cleaning bodies into the narrow region which allowing the liquid cooling media to pass therethrough;

second sieve means substantially disposed within said first sieve means for forming a restricted passage means for the cleaning bodies in the narrow region and for introducing the cleaning bodies into the restricted passage means in cooperation with said first sieve means while allowing the liquid cooling media to pass therethrough into the conduit means; and extraction passage means provided on said conduit means and partially disposed downstream of said restricted passage means for receiving the cleaning bodies from said first and second sieve means through said restricted passage means.

2. The apparatus as defined in claim 1, wherein said restricted passage means comprise two throat portions defined by the lower portions of said first and second sieve means, said throat portions each being spaced from a longitudinal center axis of said conduit means.

3. The apparatus as defined in claim 2, wherein one of said throat portions is disposed adjacent to a first portion of a side wall of said conduit means, and the other is adjacent to a second portion of the side wall disposed opposite the first portion of the side wall.

4. The apparatus as defined in claim 2, wherein at least a portion of the first and second sieve means are in an abutting relationship, and wherein guide means made of thin plates are disposed in an area of the abutment between said first sieve means and said second sieve means for preventing the cleaning bodies from adhering to the first and second sieve means in the area of abutment.

5. The apparatus as defined in claim 2, further including water jet means disposed under said second sieve means for jetting water in a direction of said first and second sieve means for preventing small pieces of various material from sticking on said first and second sieve means.

6. Apparatus for intercepting cleaning bodies used for cleaning a tube-type heat-exchanger, the apparatus comprising:

a cylindrical body through which a cooling water flows;

a pair of first grating disposed in said cylindrical body for defining a relatively narrow region in a downstream portion of the conduit means, the pair of first gratings receiving and introducing the cleaning bodies from said heat-exchanger into the relatively narrow region;

a shaft means connected to each of the first gratings for controlling a positioning thereof, said shaft means extending in a direction traversing a center axis of said cylindrical body and being rotatably supported by said cylindrical body;

a pair of second gratings substantially disposed with said first gratings for forming a pair of throat portions at lower portions of said first and second gratings;

a further shaft means connected to each of said second gratings for controlling a positioning thereof, said further shaft means extending perpendicularly to said shaft means of said first gratings and being rotatably supported by said cylindrical body; and a pair of extraction tubes each so mounted on said cylindrical body that a first end of each of said extraction tubes project into said cylindrical body, the first ends of said extraction tubes being disposed under said throat portions whereby the cleaning bodies from said first and second gratings are removed from said cylindrical body through said throat portions and extraction tubes.

7. The apparatus as defined in claim 6, wherein said throat portions are symmetrical with respect to a longitudinal center axis of said cylindrical body, and are disposed near a side wall of said cylindrical body.

8. The apparatus as defined in claim 6, wherein said first and second gratings have a plurality of parallel plates forming planes on which the cleaning bodies roll and through which a cooling water passes, major portions of said parallel plates of said first gratings are disposed above an abutment between said parallel plates of first gratings and said parallel plates of second gratings.

9. The apparatus as defined in claim 8, further including guide members for covering said abutment between said parallel plates of first gratings and said parallel plates of second gratings.

10. An apparatus for intercepting cleaning bodies used for cleaning a tube-type heat-exchanger, the apparatus comprising:

a cylindrical body in which a cooling water flows;

a pair of first gratings disposed in said cylindrical body for defining a narrow region in a downstream portion of the conduit means, the pair of first gratings receiving and introducing the cleaning bodies from said heat-exchanger into the narrow region;

first shaft means secured to the first pair of gratings and extending in a direction traversing a center axis of said cylindrical body and being rotatably supported by said cylindrical body for controlling a positioning of the pair of first gratings;

two pair of second gratings substantially disposed within said first gratings for forming a pair of throat portions at the lower portions of said first and second pairs of gratings;

second shaft means fixed to said two pair of second gratings and extending perpendicularly to said first shaft means and being rotatably supported by said cylindrical body for controlling a positioning of the two pair of second gratings; and a pair of extraction tubes each so mounted on said cylindrical body that a first end of each of said extraction tubes projects into said cylindrical body and is disposed under one of said throat portions.

11. The apparatus as defined in claim 10, wherein each of said of throat portions is defined by one of said two pairs of second gratings forming a V-shape in a vertical plane perpendicular to said second shaft means.

12. The apparatus according to claim 1, wherein said first sieve means includes at least a pair of sieves having a substantially flat sieve face, said second sieve means includes at least a pair of sieves having a substantially flat sieve face, and wherein the pair of sieves of the first sieve means are arranged so that the narrow region is of a V-shape and the pair of sieves of the second sieve means are arranged so as to define a generally inverted V-shaped region.

* * * * *